US005582016A

United States Patent [19]

Gier et al.

[11] Patent Number: 5,582,016

[45] Date of Patent: Dec. 10, 1996

[54] CONDITIONING AND LOADING APPARATUS AND METHOD FOR GAS STORAGE AT CRYOGENIC TEMPERATURE AND SUPERCRITICAL PRESSURE

[75] Inventors: Harold L. Gier; Richard L. Jetley, both of Boulder, Colo.

[73] Assignee: Aerospace Design & Development, Inc., Boulder, Colo.

[21] Appl. No.: 458,797

[22] Filed: Jun. 2, 1995

Related U.S. Application Data

[63] Continuation-in-part of Ser. No. 879,581, May 7, 1992, abandoned.

[51] Int. Cl.[6] ..... F17C 9/02

[52] U.S. Cl. ..... 62/50.2; 62/48.1

[58] Field of Search ..... 62/50.1, 50.2, 62/48.1

[56] References Cited

U.S. PATENT DOCUMENTS

| | | | |
|---|---|---|---|
| 1,448,590 | 3/1923 | Gensecke . | |
| 1,459,158 | 6/1923 | Lisse . | |
| 2,562,164 | 7/1951 | Hinkson . | |
| 2,964,918 | 12/1960 | Hansen et al. | 62/50.1 |
| 2,997,855 | 8/1961 | Templer et al. | 62/50.2 |
| 3,062,017 | 11/1962 | Balcar et al. . | |
| 3,227,208 | 1/1966 | Potter, Jr. et al. . | |
| 3,260,061 | 7/1966 | Hampton et al. | 62/50.2 |
| 3,302,418 | 2/1967 | Walter | 62/50.2 |
| 3,318,307 | 5/1967 | Nicastro . | |
| 3,354,664 | 11/1967 | Van Der Ster et al. . | |
| 3,570,481 | 3/1971 | Woodberry . | |
| 3,572,048 | 3/1971 | Murphy . | |
| 3,633,372 | 1/1972 | Kimmel | 62/50.1 |
| 3,699,775 | 10/1972 | Cowans . | |
| 3,827,246 | 8/1974 | Moen et al. . | |
| 3,875,749 | 4/1975 | Baciu . | |
| 3,946,572 | 3/1976 | Bragg | 62/50.1 |
| 4,049,409 | 9/1977 | Rothe et al. . | |
| 4,181,126 | 1/1980 | Hendry . | |
| 4,274,851 | 6/1981 | Stokes . | |
| 4,326,867 | 4/1982 | Stokes . | |
| 4,500,432 | 2/1985 | Poole et al. . | |
| 4,961,325 | 10/1990 | Halvorson et al. . | |
| 4,977,747 | 12/1990 | Frejaville et al. . | |
| 5,237,824 | 8/1993 | Pawliszyn . | |

OTHER PUBLICATIONS

"I Dived On Liquid Air", Paul J. Tzimoulis, Skin Diver, 1967, Jun. pp. 22–29 128/201.21.

*Primary Examiner*—Ronald C. Capossela
*Attorney, Agent, or Firm*—Harold A. Burdick

[57] ABSTRACT

A conditioning and loading apparatus and method are disclosed for gas storage at cryogenic temperature and supercritical pressure. The apparatus is self-contained and portable and includes first and second precooling stages utilizing heat exchange with vented system fluids to cool the gas received by the apparatus at supercritical pressure. A third cooling stage includes heat exchange in a liquid nitrogen bath before loading of the gas into a container.

17 Claims, 7 Drawing Sheets

A) 100% LOADING DENSITY

B) 80% LOADING DENSITY

C) 60% LOADING DENSITY

CONDITIONING AND LOADING APPARATUS AND METHOD FOR GAS STORAGE AT CRYOGENIC TEMPERATURE AND SUPERCRITICAL PRESSURE

GOVERNMENT SUPPORT

This invention was made with Government support under contract awarded by the National Aeronautics and Space Administration. The Government has certain rights in the invention.

RELATED APPLICATION

This application is a continuation-in-part of prior U.S. patent application Ser. No. 07/879,581 filed May 7, 1992, abandoned and entitled "Loading, Storage and Delivery Apparatus and Method For Fluid at Cryogenic Temperature".

FIELD OF THE INVENTION

This invention relates to loading apparatus and methods, and, more particularly, relates to conditioning and loading of gas for storage at cryogenic temperature and supercritical pressure.

BACKGROUND OF THE INVENTION

High pressure, ambient temperature gas storage and delivery devices have been heretofore suggested for providing attitude independent supply of mixed gasses such as breathable air to a user thereof. Such devices, while in use, have limited gas delivery time, are bulky, and must be operated at extremely high pressures.

Liquid air storage and delivery devices have also been suggested (see U.S. Pat. Nos. 1,448,590, 3,318,307, 3,570,481, 3,572,048, 4,181,126, 3,699,775, 1,459,158, and 3,227,208), but suffer from limited standby time due to oxygen enrichment inherent in such storage, some being unduly complex in an effort to confront this problem, are not attitude independent, and are often quite heavy.

A dispenser for cryogenic temperature elemental and compound gasses (below −175° F.) such as oxygen held for use at supercritical pressure (above 730 psia) has been heretofore suggested (see U.S. Pat. No. 3,062,017) wherein a primary, active heat transfer mechanism (i.e., an electrical heating element, as opposed to a passive heat exchanger as set forth hereinbelow) is utilized to pressurize the storage vessel having liquid oxygen loaded therein at atmospheric pressure (thus making the dispenser less than desirable as an air supply, where oxygen enrichment could occur while liquid air is in standby storage) for expelling the oxygen.

Pressure sensing is thereafter used to sense the heat transfer needs in the vessel to maintain pressure therein above critical pressure by activating the heating element periodically. An auxiliary passive heat exchanger is provided for situations where power becomes unavailable, but only for use in maintaining pressure, the passive system being, apparently, incapable of reasonably initiating vessel pressurization. The passive heat exchange is done utilizing means separate from the dewar and remains encumbered by complex sensing and activating mechanisms (blinds for admitting or shutting out radiant energy) to assure proper heat input. Improvement in such dispensers could thus still be utilized.

A variety of loading, conditioning or recovery devices have been heretofore suggested for use with various fluid storage devices (see U.S. Pat. Nos. 4,049,409, 3,354,664, 4,274,851 and 4,326,867). Such heretofore known devices have not been particularly well adapted for use in storage of cryogenic temperature gas at supercritical pressure. Nor have such devices been provided which are self-contained and portable as would be desired for emergency facility or personnel use. Further improvement is thus warranted.

SUMMARY OF THE INVENTION

This invention provides an apparatus and method for conditioning and loading gas into a container at cryogenic temperature and supercritical pressure. More particularly, this invention provides an apparatus and method for conditioning and loading mixed gasses for storage at cryogenic temperature wherein the gasses are maintained in a single phase (i.e., in a homogeneous state such that the mixture remains substantially constant in the apparatus and is distinguished by a lack of two-phase liquid/vapor interface).

The apparatus includes means for connection to a source of fluid at supercritical pressure, a conduit connected with the connecting means for conducting the fluid to the container, and heat exchange means receiving the conduit for lowering the temperature of the fluid to cryogenic temperature. The apparatus is self-contained and portable.

The heat exchange means includes first and second precooling stages which utilize vented system fluid to cool the gas. A third cooling stage is provided by passing the gas through a refrigerator, such as a liquid nitrogen bath, before loading of the gas into a container.

It is therefore an object of this invention to provide an improved gas loading apparatus and method for storage of gas at cryogenic temperature and supercritical pressure.

It is another object of this invention to provide a gas conditioning and loading apparatus which is self-contained and portable.

It is still another object of this invention to provide improved gas conditioning and loading which utilizes a plurality of cooling stages and/or vented system fluids for gas cooling.

It is still another object of this invention to provide an apparatus and method for loading cryogenic temperature mixed gas into a container at supercritical pressure and thus in a single phase in the container.

It is yet another object of this invention to provide an apparatus for conditioning and loading cryogenic temperature fluid into a container that includes a source of fluid at supercritical pressure, a conduit connected with the source for conducting the fluid to the container, and heat exchange means associated with the conduit for lowering the temperature of the fluid to cryogenic temperature, the heat exchange means having a plurality of stages.

It is still another object of this invention to provide an apparatus for conditioning and loading mixed gas into a container at cryogenic temperature and supercritical pressure and thus in a single phase in the container comprising means for conducting gas at supercritical pressure to the container, a refrigerator receiving the conducting means for cooling the gas, first cooling means associated with the conducting means for cooling the gas using heat exchange with gas vented from the container, and second cooling means associated with the conducting means for further cooling the gas using heat exchange with fluid vented from the refrigerator.

It is yet another object of this invention to provide a method for conditioning and loading cryogenic temperature gas into a container at supercritical pressure and thus in a single phase in the container comprising conducting gas at supercritical pressure to the container, cooling the gas being conducted to the container using heat exchange with gas vented from the container, and further cooling the gas being conducted to the container.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
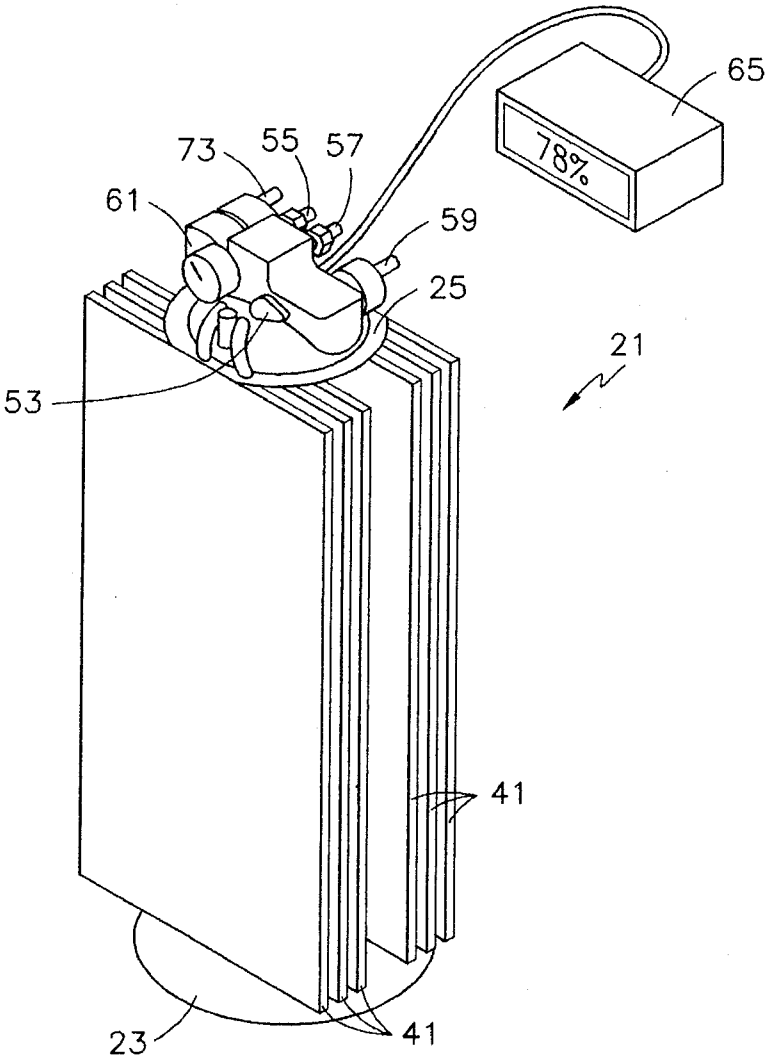
FIG. 1 is a perspective view of the storage and delivery apparatus of this invention.

Storage and delivery apparatus 21 of this invention is shown in FIG. 1 for containing supercritical pressure cryogenic air as a breathing supply to thus obviate the problems of oxygen enrichment and attitude dependence of a liquid air breathing bottle. The use of a supercritical cryogenic fluid state for the air provides a gas which is in a single phase, high density condition and which can be withdrawn from any location in the apparatus which may itself be in any attitude. Supercritical pressure is required so that the air at cryogenic temperature will exhibit no two phase characteristics.

While an air delivery apparatus will be described and referred to herein, it should be understood that the apparatus could as well be utilized for any fluid such as elemental and/or compound gasses, or, most particularly, mixed gasses such as air (nitrogen-oxygen), helium-oxygen, argon-oxygen, helium-argon, methane-hydrogen, or the like where prevention of separation of the components due to gravitational effects and/or due to frictional separation from boiling of a liquid is desired.

The critical pressure for air is 37.25 atm. (547.37 psia) and the critical temperature is 132.5 K (238.54° R). The colder the initial temperature of the air (preferably down to 140° R) and to a much lesser extent the higher the pressure (preferably in a range between 750 psia and 2,000 psia), the greater will be the storage density and thus the ability to provide significant rated use times while utilizing smaller, lighter storage units.

The use of supercritical fluid also provides a standby storage advantage over liquid in that energy required to expel a pound of fluid in the single phase storage condition is greater than that required to boil-off a pound of liquid and expel the vapor (161.68 Btu/Lbm at 750 psia versus 86.67 Btu/Lbm at one atmosphere, respectively). Supercritical air may thus be stored for longer times before reservicing than liquid air.

As shown in FIGS. 1 and/or 2, apparatus 21 includes outer shell, or vacuum jacket, 23, protective head 25 (for example, a one-piece cast aluminum head) sealed to shell 23 and pressure vessel 27 within shell 23 for containing the air. Fill line 29 passes through shell 23 and vessel 27 at inlet 31 for filling and/or refilling as hereinafter set forth (all connections and passages with, to and from vessel 27 and shell 23 set forth herein being formed by means known to those skilled in the pertinent art). Passive heat exchange and fluid transport system 33 is connected to vessel 27 at outlet 35 for conducting air expelled from vessel 27 to a use destination (for example to the carriage and conditioning unit hereinafter described).

Insulation 37 fills, and is vacuum jacketed within, space 39 between vessel 27 and shell 23 and can be, for example, formed of ten layers of multi-layered insulation consisting of double aluminized MYLAR spaced with tissue glass (a borosilicate fiber paper) or polyester netting. Fins 41 (in one embodiment being about four inches wide by 0.083 inch thick aluminum fins) are welded to, or formed integrally with (though they could also be remote from the shell), shell 23 for effectively increasing the surface area of the shell exposed to ambient temperature air to enhance heat exchange as discussed in more detail hereinbelow.

Vent line 43 is connected with vessel 27 for relief venting through relief valve 45 and to maintain pressure during standby and during filling. Relief valve 45 should include a TEFLON seal and be rated for cryogenic temperatures, and as illustrated is preferably biased at atmospheric pressure for relieving top pressure and thus reducing pressure through transport system 33 without waste of fluid. Relief valve 47 is employed as a final high reliability safety device, and should be sized to relieve at approximately 10% (approximately 200 psi) above relief pressure of valve 45.

Flow control valves 49, 51 and 53 are manual valves for control of filling, draining and use of apparatus 21, and may be bellows type valves of all welded construction designed for temperature cycling applications, and/or may be combined into one or more operational units. Quick disconnects 55, 57, and 59 are provided for making required connections to a loading apparatus (for example, as hereinafter described) or carriage and conditioning unit.

Pressure gauge 61, for example a small bourdon tube pressure gauge, is used for checking tank pressure, and quantity sensor 63 having readout 65 monitors fluid quantity in vessel 27 (for example, using a capacitance probe to measure the dielectric constant which varies from approximately 1.4 in the full condition to 1.0 in the empty condition). An audible alarm can be provided to alert a user when the fluid quantity reaches a selected low level, all electronics being powered, for example, by a 9 volt battery.

Figure 2:
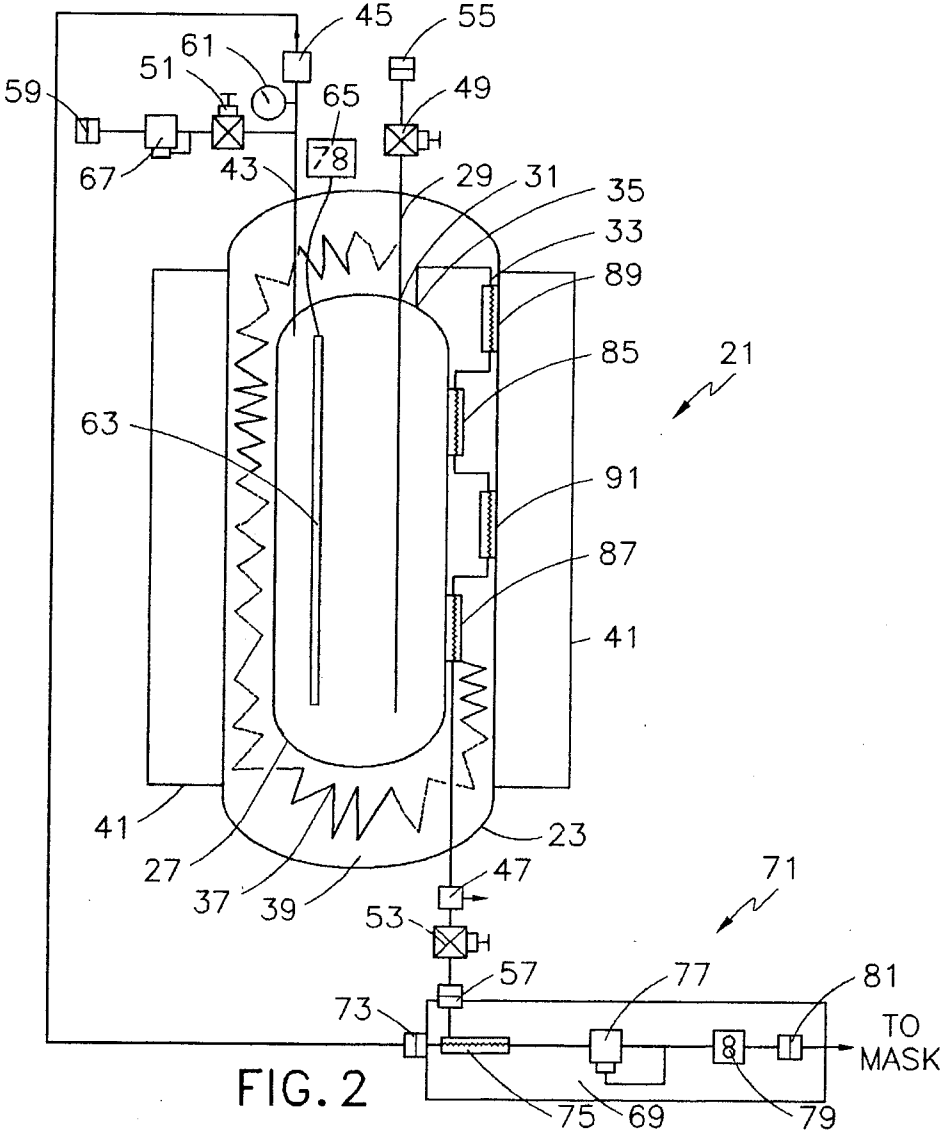
FIG. 2 is a schematic diagram of the apparatus of FIG. 1.

Pressure regulator 67 is a back-pressure regulator used, in conjunction with valve 51, to maintain pressure during standby and filling operations. As shown in FIG. 2, line 43 may be couplable through valve 45 with conditioning unit 69 at carriage and conditioning unit 71 using quick disconnect 73 so that air expelled therethrough may be used in the system.

Conditioning unit 69 includes heat exchanger 75 for heating expelled air to a breathable temperature, pressure regulator 77, optional flowmeter 79 and quick disconnect 81 for connection with a utilization device such as a mask.

Configuration of the various components varies with operation. During storage, valves 49 and 53 and quick disconnects 55, 57 and 81 are all closed. During loading operations valves 49 and 51, quick disconnects 55 and 59 and pressure regulator 67 are operational. During standby, valve 51, quick disconnect 59 and pressure regulator 67 remain open, while in operation valve 51, quick disconnect 59 and pressure regulator 67 are closed, and valve 53 is opened.

Vessel 27, in one particularly useful embodiment, has a volume of less than 4.2 liters (preferably about 4 liters), the apparatus having an overall diameter of about five inches, length of about 22 inches, operating pressure of 1,600 psia, and weight empty of about 10.7 pounds (filled weight of about 19 pounds) for a rated delivery time of about one hour ("rated delivery" herein refers to NIOSH rating of 40 SLM (standard liters per minute) for breathing apparatus, equating to about 6.7 lbs. of air per hour of delivery). In such case, vessel 27 is made of titanium, though other materials could be used.

By way of further example, for a rated time of two hours at the same operating pressure, the apparatus having a titanium vessel 27 weighs under 30 pounds filled, has a vessel volume of about 7.2 liters, a diameter of 6.5 inches and a length of about 25 inches.

Figure 4:
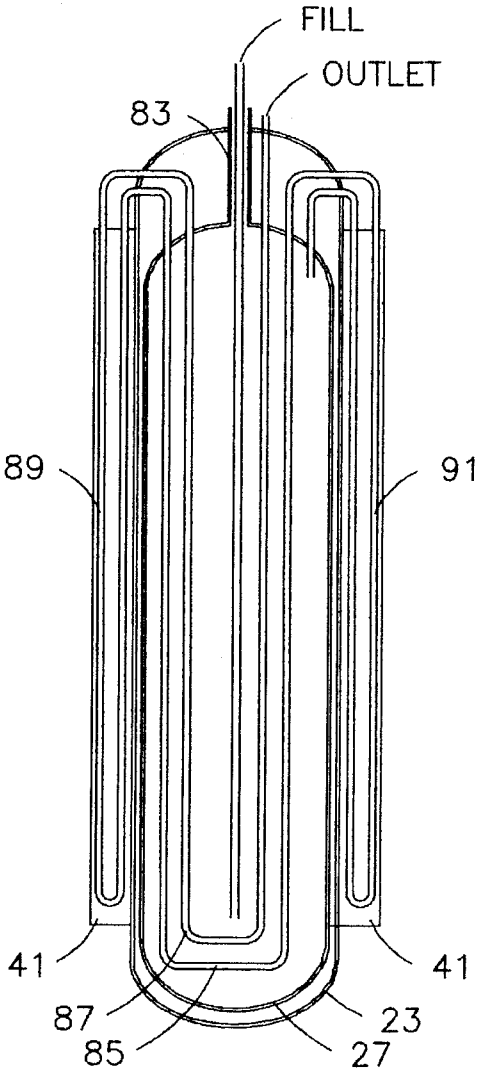
FIG. 4 is a diagrammatic sectional illustration of the storage and delivery apparatus of this invention.

Apparatus weight depends on vessel 27 volume, operating pressure and materials. Pressure vessel and outer shell materials could include composites such as FIBERGLASS, KEVLAR or graphite. Metals that could be used include stainless steel, aluminum, INCONEL or titanium. Aluminum or composite pressure vessels would require bimetal joints, with a composite vessel 27 possibly including an aluminum liner and neck plug 83 (shown in FIG. 4 for housing inlet and outlet plumbing and for, in part, positioning vessel 27 in shell 23) overlaid with an S-glass/epoxy composite (a composite fabric heretofore used in aerospace applications). The advantage in weight of such construction is significant, with a 4 liter apparatus (rated use exceeding 60 minutes) having a diameter of 4.5 inches and a vessel weight of less than four pounds. Overall, weights for a 4 liter apparatus range from about 10.7 to 16.4 pounds at an operating pressure of 1,600 psig, the lightest having a titanium, INCONEL 718 or aluminum (6061-T6 welded and heat treated with a burst pressure in excess of 6,000 psig) vessel 27 with an aluminum shell 23.

Figure 3:
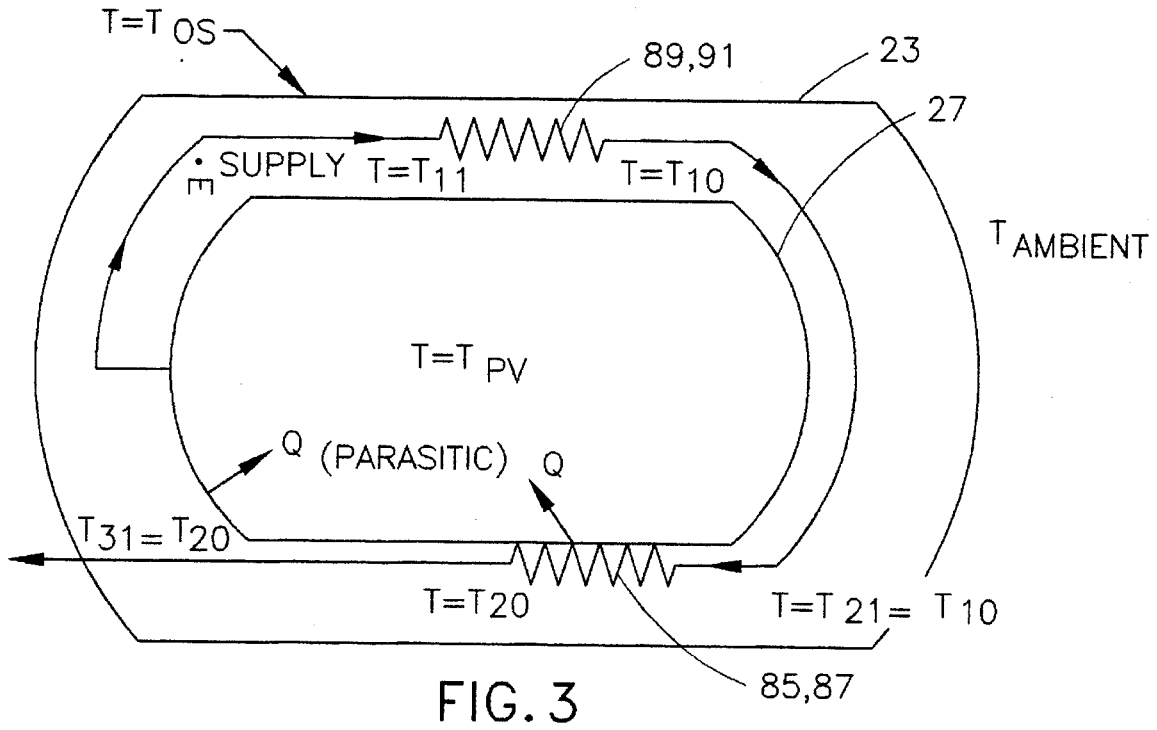
FIG. 3 is a diagrammatic illustration of heat exchange in the apparatus of FIG. 1.
Figure 7:
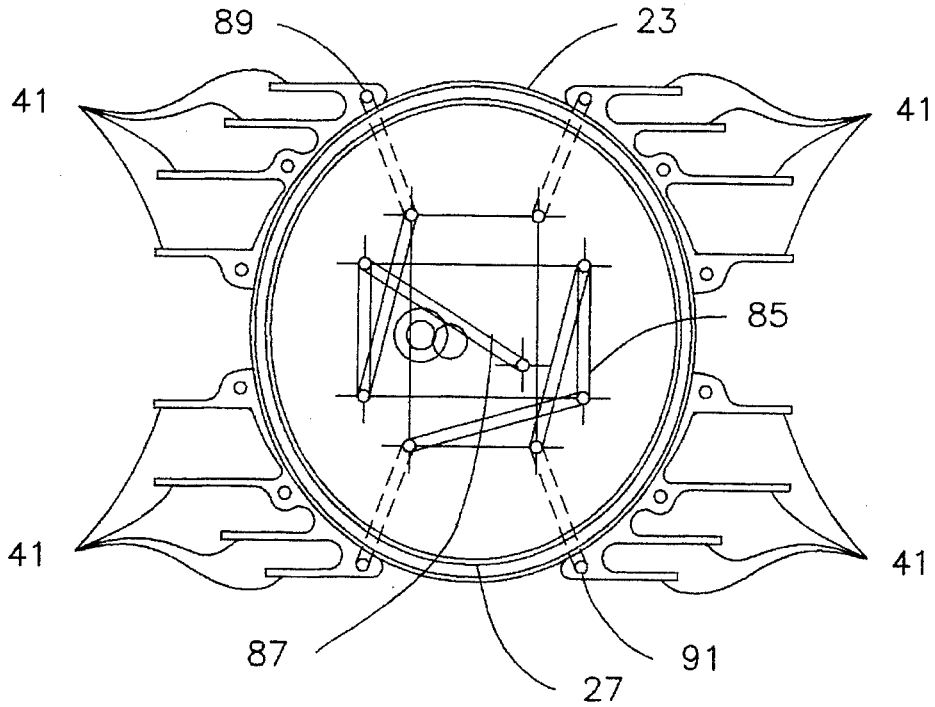
FIG. 7 is a sectional view taken through section line 7—7 of FIG. 6.

Referring now to FIGS. 2 and 3, passive heat exchange system 33 is a double loop heat exchange system (a single loop system could be used) including inner exchange loop portions 85 and 87 connected either to the outer part of vessel 27 or passing into vessel 27 in direct contact with fluid therein. Outer exchange loop portions 89 and 91 are connected with shell 23 or fins 41 or could be made integral to fins 41 as shown in FIG. 7. The heat exchange loop portions are preferably constructed of ⅛" diameter aluminum tubing, though other materials could be utilized.

Sufficient heat must be efficiently transported from outer shell 23 to pressure vessel 27 to maintain the gas in the vessel in the single phase and to provide expulsion energy for delivery of the gas from the vessel. A design to provide adequate heat transfer for expulsion must recognize that the process is a transient one. Fluid conditions and properties constantly change throughout the entire expulsion process.

For example, the expulsion energy for supercritical air ranges from approximately 35 BTU/Lbm to 160 BTU/Lbm in the pressure and temperature range of interest, with the integrated average expulsion energy being approximately 65 BTU/Lbm. Since heat leak through plumbing and other fixtures alone is insignificant compared to that required to expel the air needed (only about 9.0 BTU/Hr for a shell temperature of 530° R and a vessel temperature of 180° R) for use by an individual user at maximum exertion (estimated to be about 16.0 lbm/hr), mass flow heat exchange system 33 must be calculated to deliver sufficient heat for operation of the apparatus.

An example demonstrating heat transfer requirement for a single point in the expulsion process follows. As illustrated by FIG. 3, expelled tank fluid passes through heat exchangers 89,91 increasing its temperature to nearly that of the surface of outer shell 23 (preferably by free convection to the ambient air though various means of forced convection of ambient air to shell 23 could be utilized to provide more energy exchange). The fluid then flows to heat exchangers 85,87, respectively, cooling the fluid and dumping heat for fluid expulsion and single phase maintenance into fluid remaining in pressure vessel 27. The maximum amount of heat (Q) that can be transported from shell 23 to vessel 27 depends on the mass flow rate of outflowing fluid ($m_{supply}$), the specific heat of the cryogenic air ($C_p$), and the temperature difference between shell 23 and vessel 27 as in the following equation:

$$Q=m_{supply}C_p(T_s-T_v)$$

Since the $C_p$ of cryogenic air varies with temperature, a more accurate representation of the heat transported is:

$$Q=m_{supply}(h_s-h_v)$$

where $h_s$ is the enthalpy of air at the outer shell temperature and fluid pressure and $h_v$ is the enthalpy of air at the pressure vessel temperature and fluid pressure.

A realistic number for heat exchanger efficiency is considered to be 0.90, so that the Q calculated above would be multiplied by this efficiency twice (for external and internal heat exchangers) to obtain a heat flux for the heat exchanger described. Assuming a nominal fluid pressure of 800 psia, an ambient temperature of 530° R ($h_s$=122 BTU/Lbm) and pressure vessel fluid temperature of 150° R ($h_v$=−48 BTU/Lbm), the total Q transferred to the pressure vessel fluid is $$Q=(0.9)(0.9)16.0Lbm/Hr(122-(-48)BTU/Lbm$$

$$Q=2200BTU/Hr$$

Taking these numbers into consideration as well as the required increase in temperature of vessel 27, a double loop exchange system as shown would be required to achieve approximately 2480 Btu/hr that will drive 16 lbm/hr out of vessel 27 while remaining single phase.

In order to predict the amount of heat transfer between the outer shell and ambient air, a free convection correlation for a long horizontal cylinder geometry is utilized so that heat transfer by free convection, $q_{conv}$, from ambient air to shell 23 is given by:

$$q_{conv}=h\pi DL(T_S-T_\infty)$$

where h equals the average free convection film coefficient, D equals cylinder diameter, L equals cylinder length, $T_S$ equals cylinder temperature, and $T_\infty$ equals ambient air temperature. The free convection film coefficient may be obtained from the dimensionless Rayleigh number, Ra, by:

$$Ra=g\beta(T_S-T_\infty)L^3/\alpha v$$

where g equals acceleration of gravity, β equals the volume coefficient of expansion, α equals thermal diffusivity, and v equals dynamic viscosity.

In the case at hand, solution for Ra yields $1.4\times10^9$. An appropriate correlation for the Nusselt number, Nu, is:

$$Nu_D=0.10(Ra)^{1/3}$$

which for this example is equal to approximately 110.0. The film coefficient is related to the Nusselt number by:

$$h=(Nuk)/L$$

where the thermal conductivity, k, for air at the average air temperature is 0.013 BTU/Hr-Ft-°F. This results in an average film coefficient, h, of 0.95 BTU/Hr-Ft$^2$-°F.

Thus, for an outer shell area of approximately 2.5 ft$^2$, an ambient temperature of 530° R and average shell temperature of 300° R, the total amount of heat available from free convection will be 550 BTU/Hr. Therefore, a higher product of film coefficient and outer shell 23 surface area is required in order to transfer adequate heat to vessel 27 to maintain desired pressure. Since the free convection heat transfer coefficient is fixed due to geometry and fluid conditions, the only method to increase this product is to effectively increase the surface area of shell 23 as is done utilizing fins 41.

Figure 6:
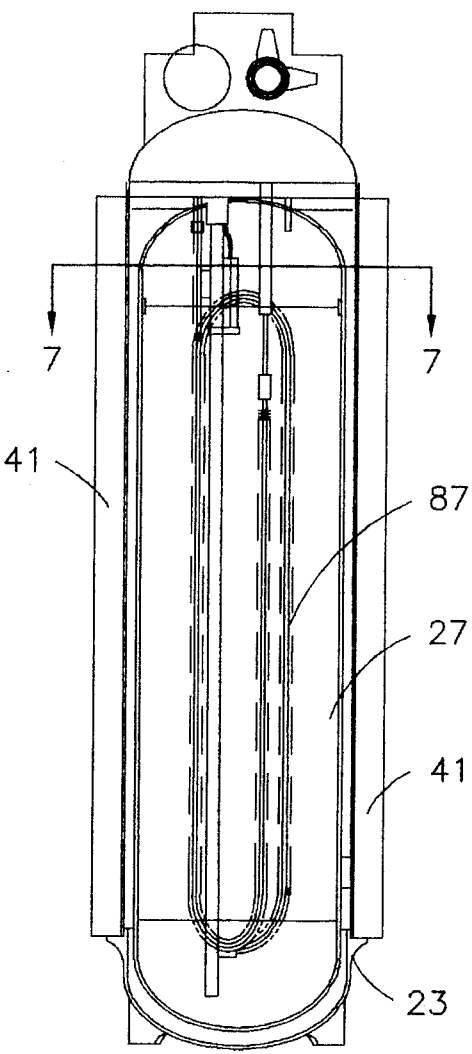
FIG. 6 is a sectional view illustrating part of the inner routed portion of the heat exchanger of the storage and delivery apparatus of this invention.
Figure 5:
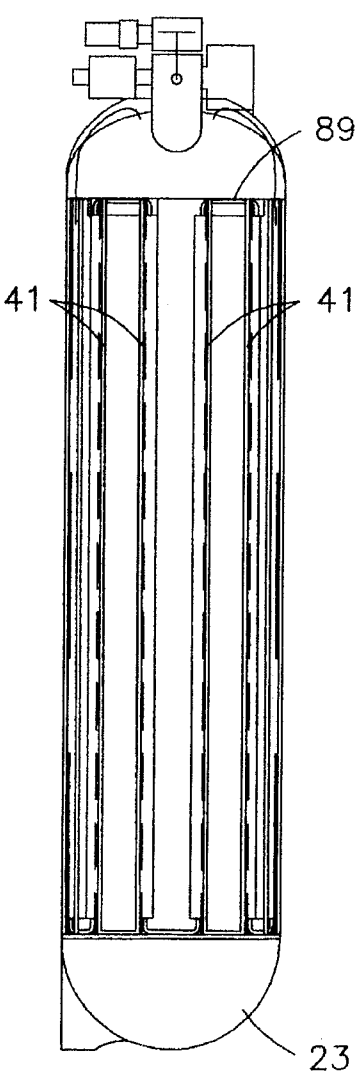
FIG. 5 is a is a side view of the outer routed portion of the heat exchanger of the storage and delivery apparatus of this invention.
Figure 8:
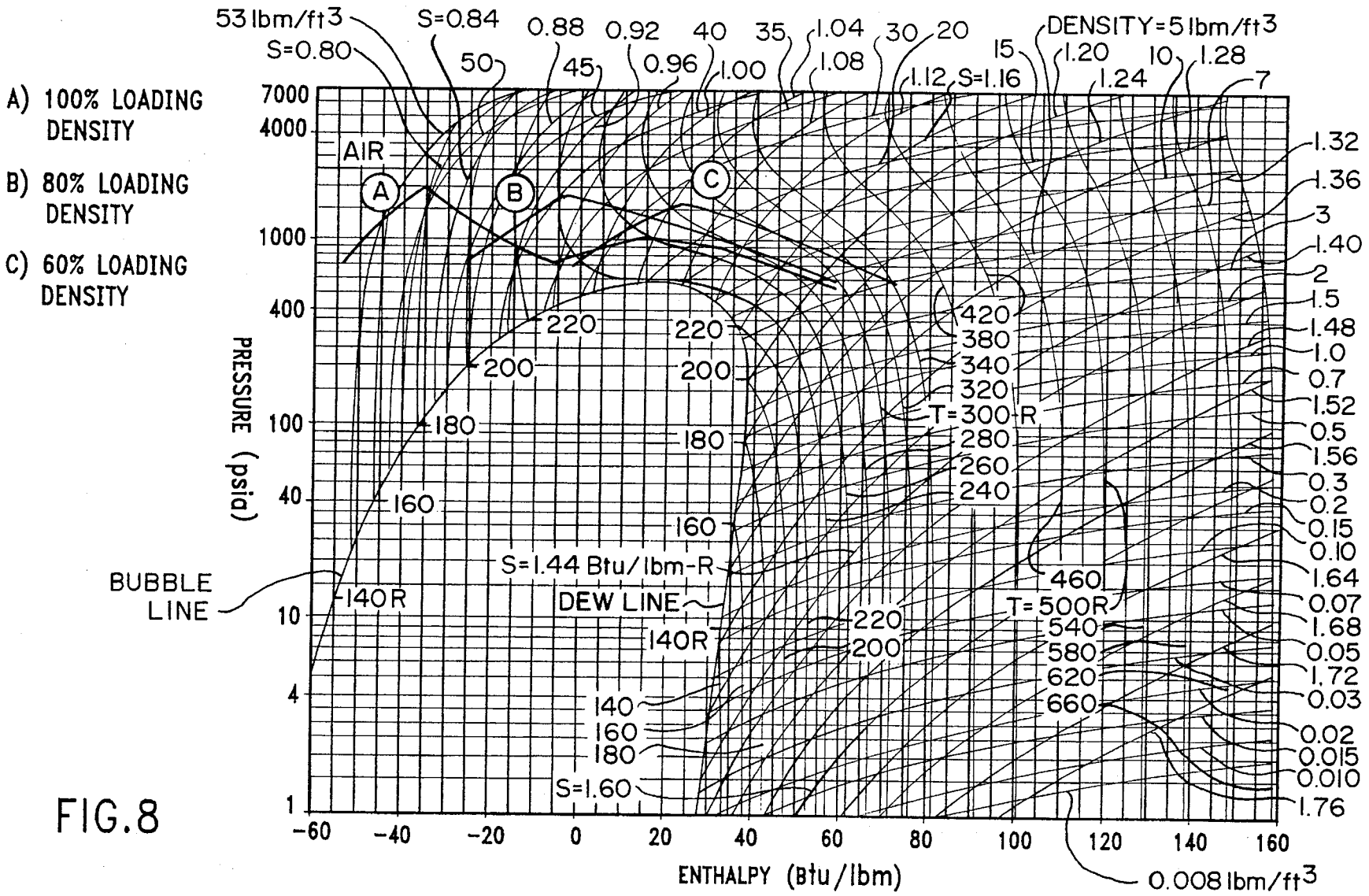
FIG. 8 is a Mollier chart showing performance of the apparatus of this invention under a variety of loading densities.

FIGS. 4 through 7, and particularly FIGS. 5 through 7 wherein a preferred arrangement is illustrated, show routing of the heat exchange loop portions as suggested hereinabove. For a 3 liter tank design, 63–64 feet total of tubing is utilized for heat exchange system 33. FIG. 8 is a Mollier chart having plotted thereon results of various tests illustrating an adequate degree of separation of the transient fluid condition from the two-phase region utilizing the apparatus of this invention.

While not illustrated herein, vessel 27 is preferably supported in shell 23 on neck tube support 83 attached to both vessel 27 and shell 23. Bumpers, or pads, would be desirable adjacent to the lower, unsupported, end of vessel 27 to thwart movement of vessel 27 in excess of maximum allowable stress to neck 83 or its connections to vessel 27 and shell 23.

Figure 10:
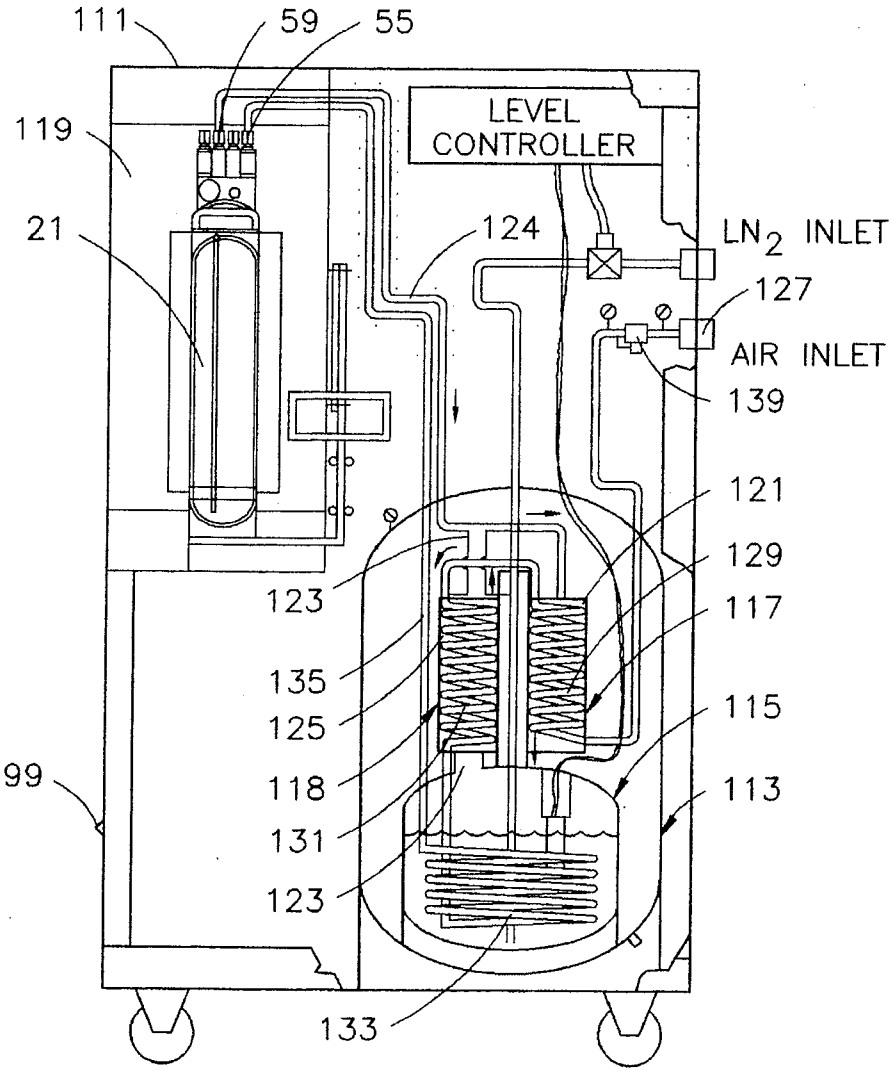
FIG. 10 is a schematic sectional view of the loading apparatus of FIG. 9.
Figure 9:
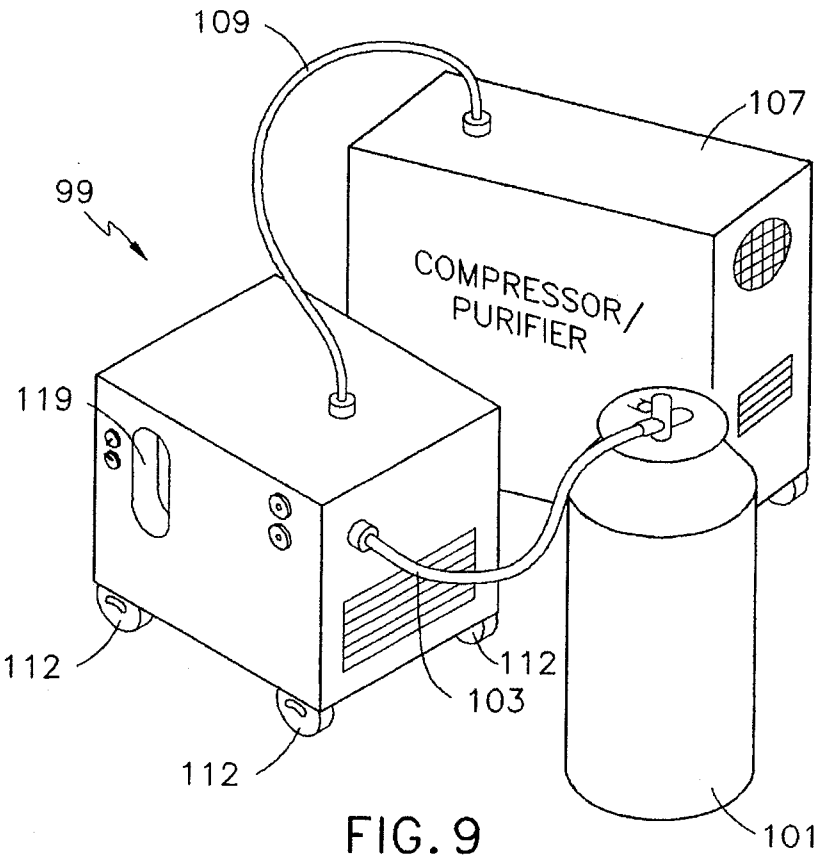
FIG. 9 is a perspective view of the loading apparatus of this invention.
Figure 12:
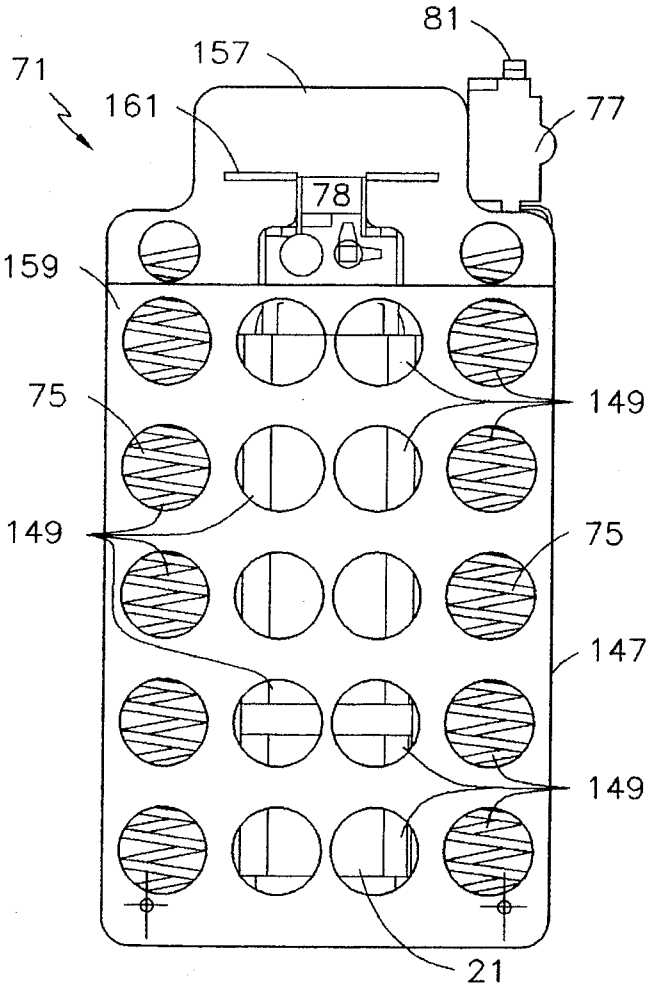
FIG. 12 is a rear view of the carriage and conditioning unit of this invention.
Figure 11:
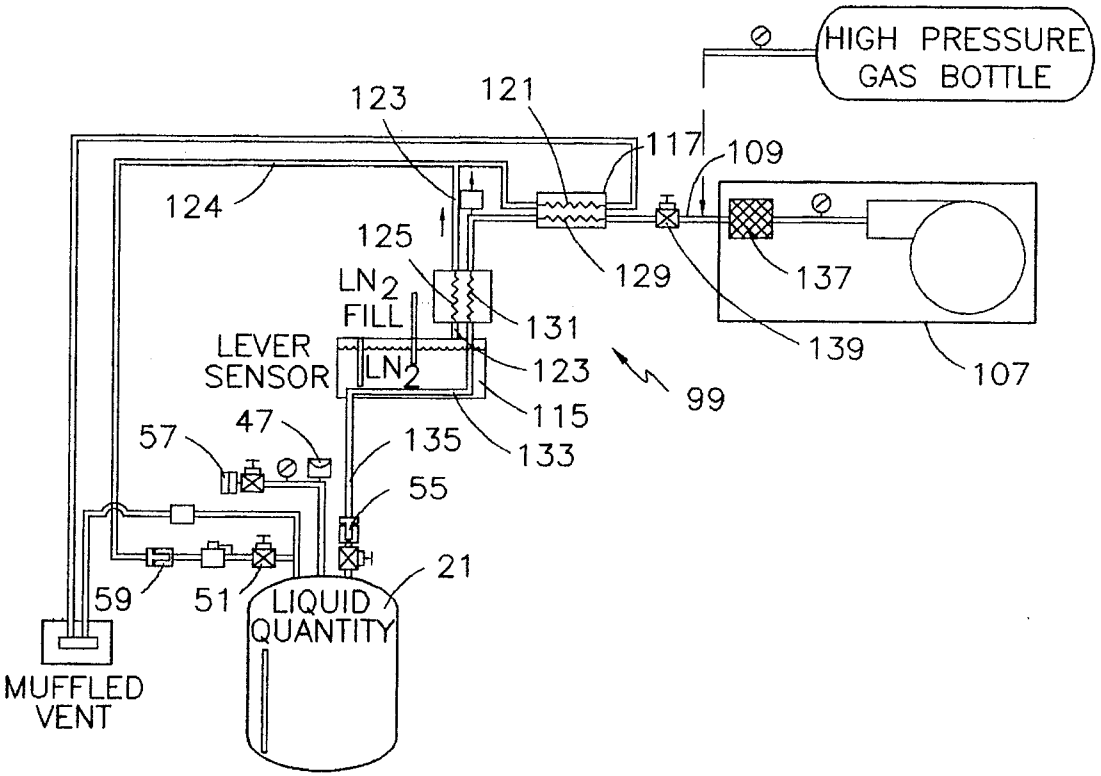
FIG. 11 is a diagram illustrating operation of the loading apparatus of FIG. 9.
Figure 15:
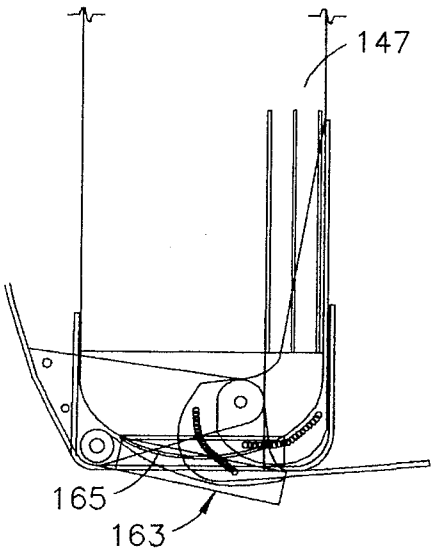
FIG. 15 is a partial schematic sectional view of the unit of FIG. 12.
Figure 14:
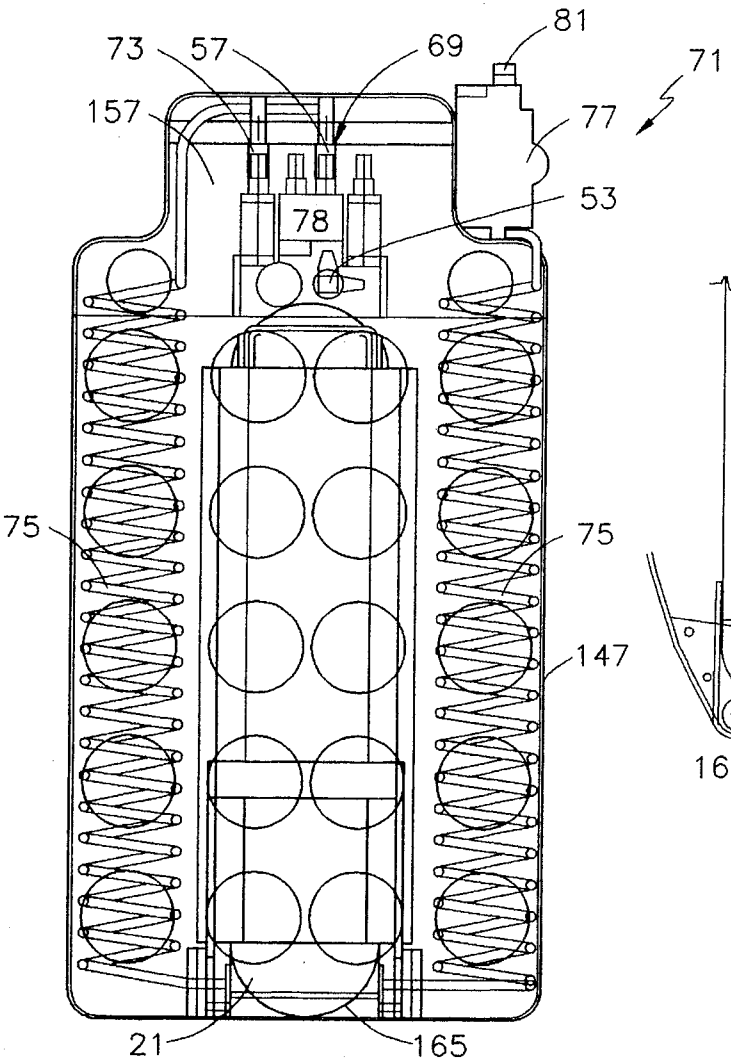
FIG. 14 is a schematic sectional view of the unit of FIG. 12.
Figure 13:
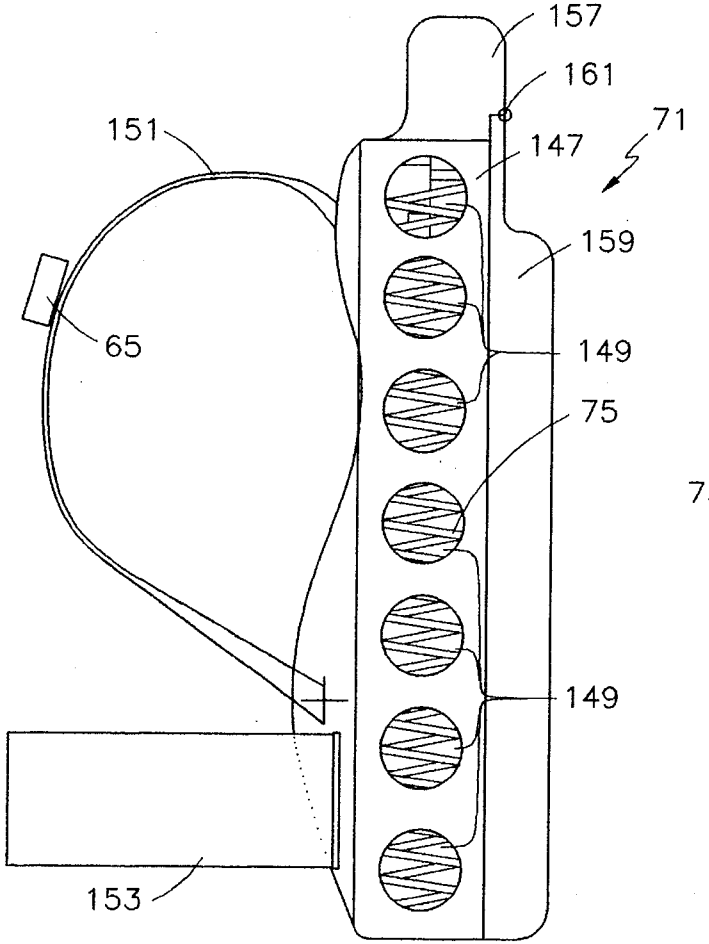
FIG. 13 is a side view of the unit of FIG. 12.

FIGS. 9 through 11 illustrate loading apparatus 99 of this invention having coolant (such as $LN_2$, i.e., liquid nitrogen) supply 101 connected thereto by supply conduit 103 (an $LN_2$ refrigerator or other means could be utilized). Air supply 107 is connected to apparatus 99 by conduit 109 (a compressor being illustrated, though a high pressure compressed air bottle could also be utilized). An alternative fill apparatus could be provided which utilizes a source of cryogenic temperature air itself maintained at supercritical pressure, in which case, loading would be simplified even if possibly more expensive and unwieldy.

Apparatus 99 is self-contained and includes housing 111 mounted on wheels 112 (for portability), vacuum chamber 113 having $LN_2$ bath chamber 115 and precooling stages 117 and 118 therein, and storage apparatus insertion chamber, or bay, 119 for receipt thereinto of a storage apparatus to be serviced (preferably having a self aligning load, securing and quick disconnect mechanism for ease of use by an operator). Precooling stages 117 and 118 include heat exchange coil 121 (connected with the upper part of boil-off line 123 (receiving $GN_2$, i.e., gaseous nitrogen at about 140 K) and overfill vent return line 124 from fill vent quick disconnect 59 to apparatus 21 receiving fill gas vented at about 85 K) and heat exchange coil 125 connected with the lower end of boil-off line 123 (receiving $GN_2$ at about 90 K) to provide preliminary cooling (from about 285 K at the storage apparatus to about 90 K) of air received through inlet 127 from supply 107.

Exchange coils 129 and 131 are positioned adjacent to coils 121 and 125, respectively, air flowing in the coils then being passed through $LN_2$ refrigeration bath in coil 133 of conduit 135 (it should be recognized that mechanical refrigeration known to those skilled in the art could also be utilized) to lower temperature of the air to about 82 K. The air is then received in apparatus 21 through quick disconnect 55. Since the air from supply 107 is received at loading apparatus 99 at or above the critical pressure (about 800 psi), the fluid is received at apparatus 21 in the single phase condition, thus rendering apparatus 21 usable substantially immediately after filling.

Where supply compressor unit 107 is utilized rather than a high pressure gas bottle containing high purity air, filter/dryer/$CO_2$ scrubber 137 and pressure regulator 139 are provided. Compressor supply unit 107 may include for example, an oil-free 1,000 psi compressor. Various gauges, readouts, program controls and the like could be utilized to enhance ease of operation and safety of the apparatus. It should be appreciated that many types of heat exchangers could be utilized at stages 117 and 118, for example coiled finned tube-type heat exchangers.

FIGS. 12 through 15 illustrate carriage and conditioning unit 71 of this invention. Unit 71 includes pack structure 147 made, for example, of high strength, light weight molded plastic. Structure 147 has a plurality of openings 149 therein to assure proper flow of ambient air around apparatus 21 and heat exchangers 75. Air conditioning heat exchangers 75 and pressure regulator 77 are mounted on structure 147 by any convenient means, and adjustable harness 151 and waist belt 153 are mounted in selected sets of receiving slots at the back of the pack structure. Remote fluid quantity readout 65 may be attached to harness 151 for ease of observation.

Apparatus 21 is snugly maintained in structure 147 by molded head 157 and hinged door 159 connected at hinge 161. Double hinged retainer 163 having arcuate retaining surface 165 corresponding to the bottom of apparatus 21 is provided for ease of loading and unloading of apparatus 21 from unit 71 and for retaining door 159.

As may be appreciated from the foregoing, a highly reliable, self contained breathing system and loading apparatus are provided wherein long storage, standby and use times may be achieved.

What is claimed is:

1. An apparatus for conditioning and loading cryogenic temperature fluid at supercritical pressure into a container and thus in a single phase in the container comprising:

a source of fluid at supercritical pressure; a conduit connected with said source for conducting said fluid to the container; and heat exchange means associated with said conduit for lowering the temperature of said fluid to cryogenic temperature, said heat exchange means having a plurality of stages and including at least one of a mechanical refrigerator and a liquid cryogen bath.

2. The apparatus of claim 1 wherein said source is one of a high pressure gas bottle and a compressor.

3. The apparatus of claim 1 wherein said heat exchange means includes a precooling stage connected with a vent line leading from the container.

4. The apparatus of claim 1 wherein said heat exchange means includes a liquid cryogen bath having a boil-off vent, said apparatus further comprising a precooling stage having said conduit located therethrough and being connected with said boil-off vent.

5. The apparatus of claim 1 further comprising a housing having said conduit and said heat exchange means therein, said housing having means to allow ready movement of said apparatus.

6. The apparatus of claim 1 further comprising a bay having quick disconnect structure for receiving the container to be loaded.

7. An apparatus for conditioning and loading mixed gas into a container at cryogenic temperature and supercritical pressure and thus in a single phase in the container comprising:

means for conducting gas at supercritical pressure to the container;

refrigeration means receiving said conducting means for cooling said gas;

first cooling means associated with said conducting means for cooling said gas using heat exchange with gas vented from the container; and second cooling means associated with said conducting means for further cooling said gas using heat exchange with fluid vented from said refrigerator.

8. The apparatus of claim 7 wherein said refrigeration means is a liquid cryogen refrigeration means having a boil-off vent connected with said second cooling means.

9. The apparatus of claim 7 further comprising a container bay having quick connecting structure for receiving the container, said connecting structure including a fill vent connected with said first cooling means.

10. The apparatus of claim 7 further comprising a portable housing for said conducting means, said refrigerator and said first and second cooling means.

11. The apparatus of claim 7 further comprising a source of supercritical pressure gas connectable with said conducting means.

12. The apparatus of claim 7 wherein said refrigeration means is a liquid cryogen refrigeration means, said apparatus further comprising a source of liquid cryogen connectable with said refrigeration means.

13. A method for conditioning and loading cryogenic temperature gas into a container at supercritical pressure and thus in a single phase in the container comprising:

conducting gas at supercritical pressure to the container;

cooling said gas being conducted to the container using heat exchange with gas vented from the container; and further cooling said gas being conducted to the container utilizing a liquid cryogen bath.

14. The method of claim 13 further comprising venting said liquid cryogen bath and cooling said gas being conducted to the container using heat exchange with gas vented from said liquid cryogen bath.

15. The method of claim 13 further comprising providing a source of liquid cryogen for replenishing said bath.

16. The method of claim 13 further comprising providing a source of supercritical pressure fluid to be conducted to the container.

17. The method of claim 13 further comprising filling the container with said gas at a bay integral to a housing at which said gas is conducted and cooled.

* * * * *